US012692683B2

(12) United States Patent
Enomoto et al.

(10) Patent No.: US 12,692,683 B2
(45) Date of Patent: Jul. 28, 2026

(54) CONTROL DEVICE, CONTROL METHOD, AND WORK MACHINE

(71) Applicant: Komatsu Ltd., Tokyo (JP)

(72) Inventors: Ryota Enomoto, Tokyo (JP); Rie Kawamata, Tokyo (JP); Yuji Fukuda, Tokyo (JP); Takahisa Oasa, Tokyo (JP); Shozo Kikuchi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 111 days.

(21) Appl. No.: 18/855,806

(22) PCT Filed: Jul. 3, 2023

(86) PCT No.: PCT/JP2023/024646
§ 371 (c)(1),
(2) Date: Oct. 10, 2024

(87) PCT Pub. No.: WO2024/048063
PCT Pub. Date: Mar. 7, 2024

(65) Prior Publication Data

US 2025/0230626 A1 Jul. 17, 2025

(30) Foreign Application Priority Data

Aug. 31, 2022 (JP) ..... 2022-137856

(51) Int. Cl.
*E02F 3/43* (2006.01)

(52) U.S. Cl.
CPC ..... *E02F 3/434* (2013.01)

(58) Field of Classification Search
CPC ..... E02F 3/434
See application file for complete search history.

(56) References Cited

FOREIGN PATENT DOCUMENTS

| | | | |
|---|---|---|---|
| EP | 3581715 | A1 | 12/2019 |
| EP | 4012111 | A1 | 6/2022 |
| JP | 2000-344466 | A | 12/2000 |
| JP | 2006-274788 | A | 10/2006 |
| JP | 4632970 | B | 2/2011 |

*Primary Examiner* — Michael D Lang
(74) *Attorney, Agent, or Firm* — Troutman Pepper Locke LLP

(57) ABSTRACT

A control device includes a signal input unit configured to input a signal from a first signal line connected to a first switch configured to detect press and release of a momentary operation push button for setting and releasing lock of an operation of work equipment and input a signal from a second signal line connected to a second switch linked to the first switch, and a work equipment lock control unit configured to alternately switch between setting and releasing the lock of the operation of the work equipment in a case where information indicating that the push button is OFF→ON→OFF is obtained from both of the first signal line and the second signal line, and release the lock of the operation of the work equipment only when a predetermined operation is performed on a predetermined operation device of the work equipment.

11 Claims, 16 Drawing Sheets

FIG. 6

| | | WORK EQUIPMENT LOCK SW1 (N.O.) | |
|---|---|---|---|
| | | Lo | Hi |
| WORK EQUIPMENT LOCK SW2 (N.C.) | Lo | ABNORMAL Lo | ON |
| | Hi | OFF | ABNORMAL Hi |

FIG. 7

| OPERATION STATE | A | B | C | D | E |
|---|---|---|---|---|---|
| STATE OF NORMALITY/ ABNORMALITY | SW NORMALITY | SW ABNORMALITY (ABNORMALITY AT TIME OF PRESS) | SW ABNORMALITY (ABNORMALITY AT TIME OF RELEASE) | SW ABNORMALITY (ABNORMALITY AT TIME OF RELEASE) | SW ABNORMALITY (ABNORMALITY AT TIME OF PRESS) |
| CONTENT OF NORMALITY/ ABNORMALITY | AT TIME OF NORMALITY | AT TIME OF N.O. DISCONNECTION/ GROUND FAULT | AT TIME OF N.O. POWER SUPPLY FAULT | AT TIME OF N.C. DISCONNECTION/ GROUND FAULT | AT TIME OF N.C. POWER SUPPLY FAULT |
| TIME-SERIES SIGNAL AT TIME OF NORMAL ON/OFF SWITCHING OPERATION (OPERATION OF PRESSING AND RELEASING SW) | N.O. NORMAL: Hi, Lo; N.C. NORMAL: Hi, Lo; PRESS, RELEASE | N.O. DISCONNECTION: Hi, Lo; N.C. NORMAL: Hi, Lo; PRESS, RELEASE | N.O. POWER SUPPLY FAULT: Hi, Lo; N.C. NORMAL: Hi, Lo; PRESS, RELEASE | N.O. NORMAL: Hi, Lo; N.C. DISCONNECTION: Hi, Lo; PRESS, RELEASE | N.O. NORMAL: Hi, Lo; N.C. POWER SUPPLY FAULT: Hi, Lo; PRESS, RELEASE |
| SW STATE RECOGNITION OF CONTROLLER | STATE RECOGNITION: OFF ON OFF; SIGNAL CHANGE: OFF ON OFF; ABNORMAL Hi or Lo | STATE RECOGNITION: OFF OFF; ABNORMAL Lo | STATE RECOGNITION: ON; ABNORMAL Hi | STATE RECOGNITION: ON; ABNORMAL Lo | STATE RECOGNITION: OFF OFF; ABNORMAL Hi |
| ERROR REPORT | NOT PERFORMED | ERROR REPORT (N.O. DISCONNECTION/ GROUND FAULT ERROR) | ERROR REPORT (N.O. POWER SUPPLY FAULT ERROR) | ERROR REPORT (N.C. DISCONNECTION/ GROUND FAULT ERROR) | ERROR REPORT (N.C. POWER SUPPLY FAULT ERROR) |
| SWITCHING BETWEEN RELEASE/SETTING OF LOCK | SWITCHING IS PERFORMED | SWITCHING IS PERFORMED | SWITCHING IS PERFORMED | SWITCHING IS PERFORMED | SWITCHING IS PERFORMED |

FIG. 16

| NORMAL OR ABNORMAL STATE OF WORK EQUIPMENT LOCK SWITCH | SW NORMALITY | | |
|---|---|---|---|
| TRANSITION STATE <TRANSITION OF LOCK/RELEASE> | STATE S1 <LOCK → RELEASE> | STATE S2 <RELEASE → LOCK> | STATE S2a <RELEASE → LOCK> |
| SWITCHING DETERMINATION IS ESTABLISHED WHEN WORK EQUIPMENT LOCK SW STATE ESTABLISHES LAST TRANSITION DESCRIBED RIGHT | OFF ↓ ON CONTINUED FOR 0.05 [sec] OR MORE ↓ OFF | OFF ↓ ON CONTINUED FOR 0.05 [sec] OR MORE ↓ OFF | |
| LONG PRESS DETERMINATION IS ESTABLISHED WHEN WORK EQUIPMENT LOCK SW STATE ESTABLISHES TRANSITION AND DETECTION TIME DESCRIBED RIGHT | | OFF ↓ ON CONTINUED FOR 0.5 [sec] OR MORE | |
| SW PRESS CONDITION | ON IS DETECTED | | |
| SW RELEASE CONDITION | OTHER THAN ON IS DETECTED | | |

FIG. 17

| NORMAL OR ABNORMAL STATE OF WORK EQUIPMENT LOCK SWITCH | SW ABNORMALITY (ABNORMALITY AT TIME OF RELEASE) | | |
|---|---|---|---|
| TRANSITION STATE <TRANSITION OF LOCK/RELEASE> | STATE S3 <LOCK → RELEASE> | STATE S4 <RELEASE → LOCK> | STATE S4a <RELEASE → LOCK> |
| SWITCHING DETERMINATION IS ESTABLISHED WHEN WORK EQUIPMENT LOCK SW STATE ESTABLISHES LAST TRANSITION DESCRIBED RIGHT | SWITCHING DETERMINATION ACCOMPANIED BY PREDETERMINED OPERATION (FIG. 19) | OTHER THAN ON ↓ ON CONTINUED FOR 0.05 [sec] OR MORE ↓ OTHER THAN ON | |
| LONG PRESS DETERMINATION IS ESTABLISHED WHEN WORK EQUIPMENT LOCK SW STATE ESTABLISHES TRANSITION AND DETECTION TIME DESCRIBED RIGHT | | OTHER THAN ON ↓ ON CONTINUED FOR 0.5 [sec] OR MORE | |
| SW PRESS CONDITION | ON IS DETECTED | | |
| SW RELEASE CONDITION | OTHER THAN ON IS DETECTED | | |

FIG. 18

| NORMAL OR ABNORMAL STATE OF WORK EQUIPMENT LOCK SWITCH | SW ABNORMALITY (ABNORMALITY AT TIME OF PRESS) | | |
|---|---|---|---|
| TRANSITION STATE <TRANSITION OF LOCK/RELEASE> | STATE S5 <LOCK → RELEASE> | STATE S6 <RELEASE → LOCK> | STATE S6a <RELEASE → LOCK> |
| SWITCHING DETERMINATION IS ESTABLISHED WHEN WORK EQUIPMENT LOCK SW STATE ESTABLISHES LAST TRANSITION DESCRIBED RIGHT | SWITCHING DETERMINATION ACCOMPANIED BY PREDETERMINED OPERATION (FIG. 20) | OFF ↓ OTHER THAN OFF CONTINUED FOR 0.05 [sec] OR MORE ↓ OFF | |
| LONG PRESS DETERMINATION IS ESTABLISHED WHEN WORK EQUIPMENT LOCK SW STATE ESTABLISHES TRANSITION AND DETECTION TIME DESCRIBED RIGHT | | OFF ↓ OTHER THAN OFF CONTINUED FOR 0.5 [sec] OR MORE | |
| SW PRESS CONDITION | OTHER THAN OFF IS DETECTED | | |
| SW RELEASE CONDITION | OFF IS DETECTED | | |

CONTROL DEVICE, CONTROL METHOD, AND WORK MACHINE

TECHNICAL FIELD

The present disclosure relates to a control device, a control method, and a work machine.

Priority is claimed on Japanese Patent Application No. 2022-137856, filed Aug. 31, 2022, the content of which is incorporated herein by reference.

BACKGROUND ART

Patent Document 1 discloses a safety device for a work machine in which a position of a gate lock lever that blocks or communicates with a hydraulic flow path of a hydraulic pressure to a hydraulic operating device of work equipment is detected by a plurality of systems such as a combination of two switches and a combination of one switch and one potentiometer. In the safety device disclosed in Patent Document 1, in a case where the position is detected by the combination of two switches, the hydraulic flow path is blocked when input signals from the two switches are different from each other. In addition, in a case where the position is detected by the combination of one switch and one potentiometer, the hydraulic flow path is blocked when the switch is failed, or is blocked or communicated according to a signal from the potentiometer.

CITATION LIST

Patent Document

Patent Document 1: Japanese Unexamined Patent Application, First Publication

SUMMARY OF INVENTION

Technical Problem

In the safety device disclosed in Patent Document 1, in a case where the position of the gate lock lever is detected by the combination of two switches, when the switches are failed, the hydraulic flow path is blocked, and the work equipment cannot be operated. In addition, in a case where the potentiometer is used to detect the position of the gate lock lever, it is difficult to simplify the structure as compared with the combination of two switches.

In a work machine including work equipment, in a case where the operation of the work equipment is stopped in the occurrence of a failure, it may be difficult to move the work machine depending on a posture (position, angle, and the like) of the work equipment at the time of the stop. In order to move the work machine to, for example, a repair factory, it is desirable to secure a function of returning the posture of the work equipment to a state in which the work machine can be moved even in a case where a failure occurs. The degree of maintenance of the minimum function such as a traveling function in a case where a failure occurs is referred to as emergency operability. For example, even in a case where a failure occurs, the posture of the work equipment can be returned to a posture suitable for traveling, and in a case where there is no problem in traveling of the work machine, the emergency operability is good.

In the safety device disclosed in Patent Document 1, the safety can be improved by multiplexing the system by using a plurality of systems for detecting the position of the gate lock lever. However, in a case where the position of the gate lock lever is detected by the combination of two switches, the work equipment is stopped in a case where a failure occurs, so that there is a problem that emergency operability is deteriorated. In addition, in the configuration using the potentiometer, there is a problem that it is difficult to simplify the structure.

The present disclosure has been made in view of the above circumstances, and an object of the present disclosure is to provide a control device, a control method, and a work machine capable of achieving both safety and emergency operability in a configuration for locking an operation of the work equipment.

Solution to Problem

According to an aspect of the present disclosure, there is provided a control device of a work machine including work equipment, the control device including: a signal input unit configured to input a signal from a first signal line connected to a normally open first switch configured to detect press and release of a momentary operation push button for setting and releasing lock of an operation of the work equipment, and input a signal from a second signal line connected to a normally closed second switch linked to the first switch (hereinafter, a state where the push button is pressed is referred to as ON, and a state where the push button is released is referred to as OFF); and a work equipment lock control unit configured to alternately switch between setting and releasing the lock of the operation of the work equipment in a case where information indicating that the push button is OFF→ON→OFF is obtained from both of the first signal line and the second signal line, and release the lock of the operation of the work equipment only when a predetermined operation is performed on a predetermined operation device of the work equipment when the lock of the operation of the work equipment is set in a case where the information indicating that the push button is OFF→ON→OFF is obtained from only one of the first signal line and the second signal line.

According to an aspect of the present disclosure, there is provided a control method of a work machine including work equipment, the control method including: a step of inputting a signal from a first signal line connected to a normally open first switch configured to detect press and release of a momentary operation push button for setting and releasing lock of an operation of the work equipment, and inputting a signal from a second signal line connected to a normally closed second switch linked to the first switch (hereinafter, a state where the push button is pressed is referred to as ON, and a state where the push button is released is referred to as OFF); a step of alternately switching between setting and releasing the lock of the operation of the work equipment in a case where information indicating that the push button is OFF→ON→OFF is obtained from both of the first signal line and the second signal line; and a step of releasing the lock of the operation of the work equipment only when a predetermined operation is performed on a predetermined operation device of the work equipment when the lock of the operation of the work equipment is set in a case where the information indicating that the push button is OFF→ON→OFF is obtained from only one of the first signal line and the second signal line.

According to an aspect of the present disclosure, there is provided a work machine including: work equipment; and a control device including a signal input unit configured to input a signal from a first signal line connected to a normally open first switch configured to detect press and release of a momentary operation push button for setting and releasing lock of an operation of the work equipment, and input a signal from a second signal line connected to a normally closed second switch linked to the first switch (hereinafter, a state where the push button is pressed is referred to as ON, and a state where the push button is released is referred to as OFF), and a work equipment lock control unit configured to alternately switch between setting and releasing the lock of the operation of the work equipment in a case where information indicating that the push button is OFF→ON→OFF is obtained from both of the first signal line and the second signal line, and release the lock of the operation of the work equipment only when a predetermined operation is performed on a predetermined operation device of the work equipment when the lock of the operation of the work equipment is set in a case where information indicating that the push button is OFF→ON→OFF is obtained from only one of the first signal line and the second signal line.

Advantageous Effects of Invention

According to the control device, the control method, and the work machine of the present disclosure, it is possible to achieve both safety and emergency operability in a configuration for locking the operation of the work equipment.

BRIEF DESCRIPTION OF DRAWINGS

FIG. 6 A schematic diagram for describing an operation example of a work equipment controller according to the embodiment of the present disclosure.

FIG. 7 A schematic diagram for describing an operation example of the work equipment controller according to the embodiment of the present disclosure.

FIG. 16 A schematic diagram for describing an operation example of the work equipment controller according to the embodiment of the present disclosure.

FIG. 17 A schematic diagram for describing an operation example of the work equipment controller according to the embodiment of the present disclosure.

FIG. 18 A schematic diagram for describing an operation example of the work equipment controller according to the embodiment of the present disclosure.

DESCRIPTION OF EMBODIMENTS

Figure 1:
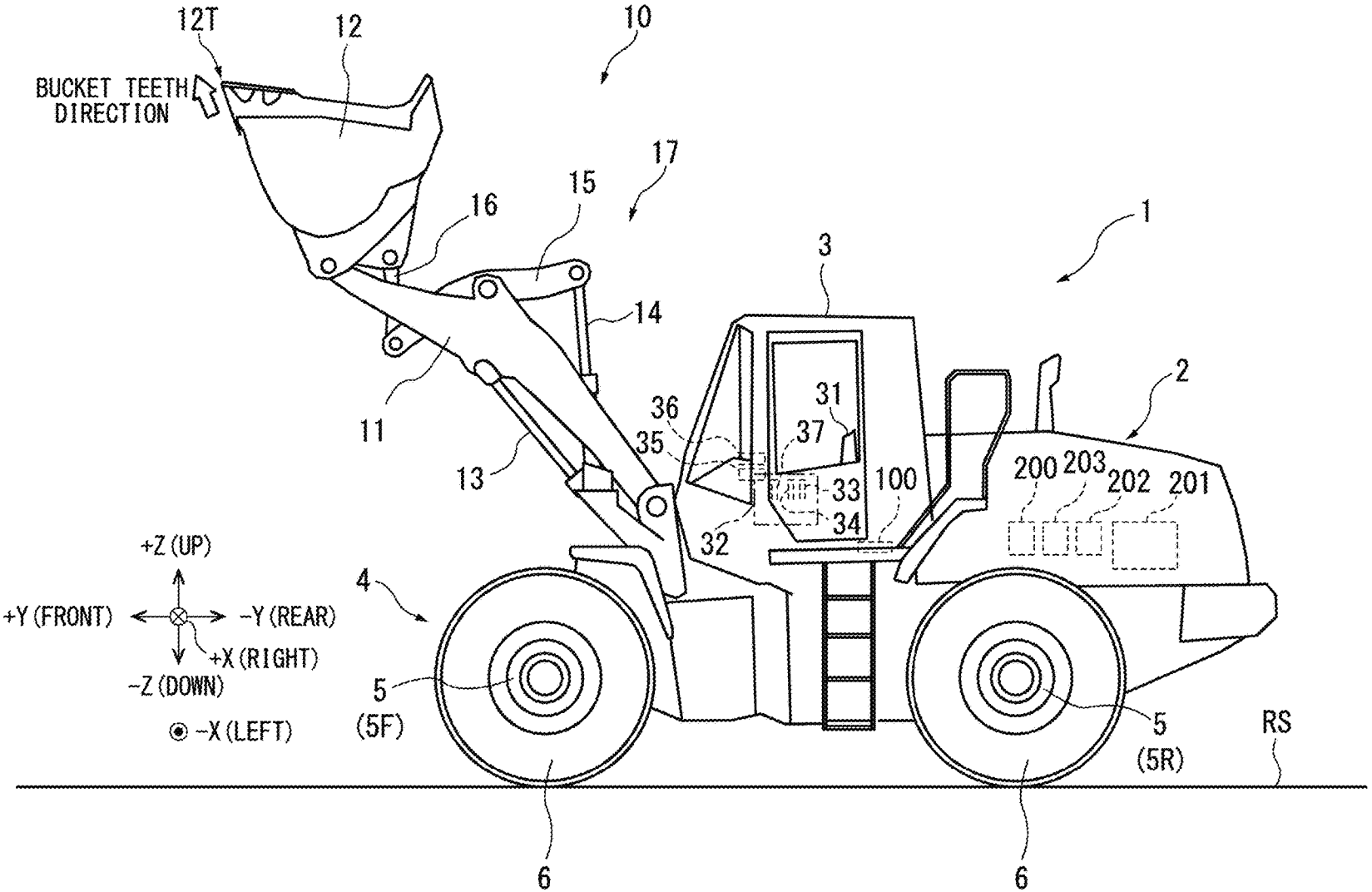
FIG. 1 A side view showing a work machine according to an embodiment of the present disclosure.
Figure 2:
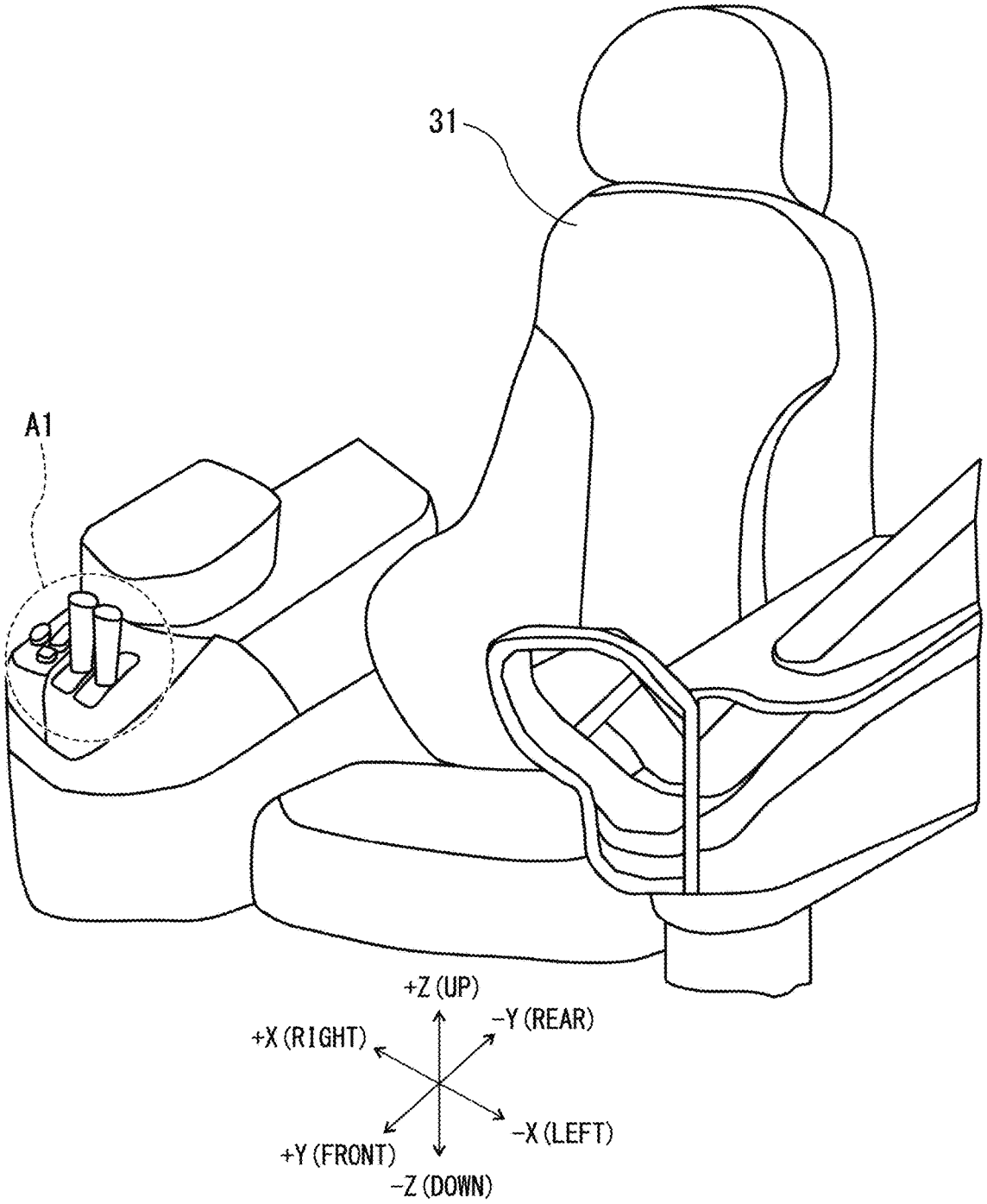
FIG. 2 A perspective view schematically showing the periphery of a driver's seat according to the embodiment of the present disclosure.
Figure 3:
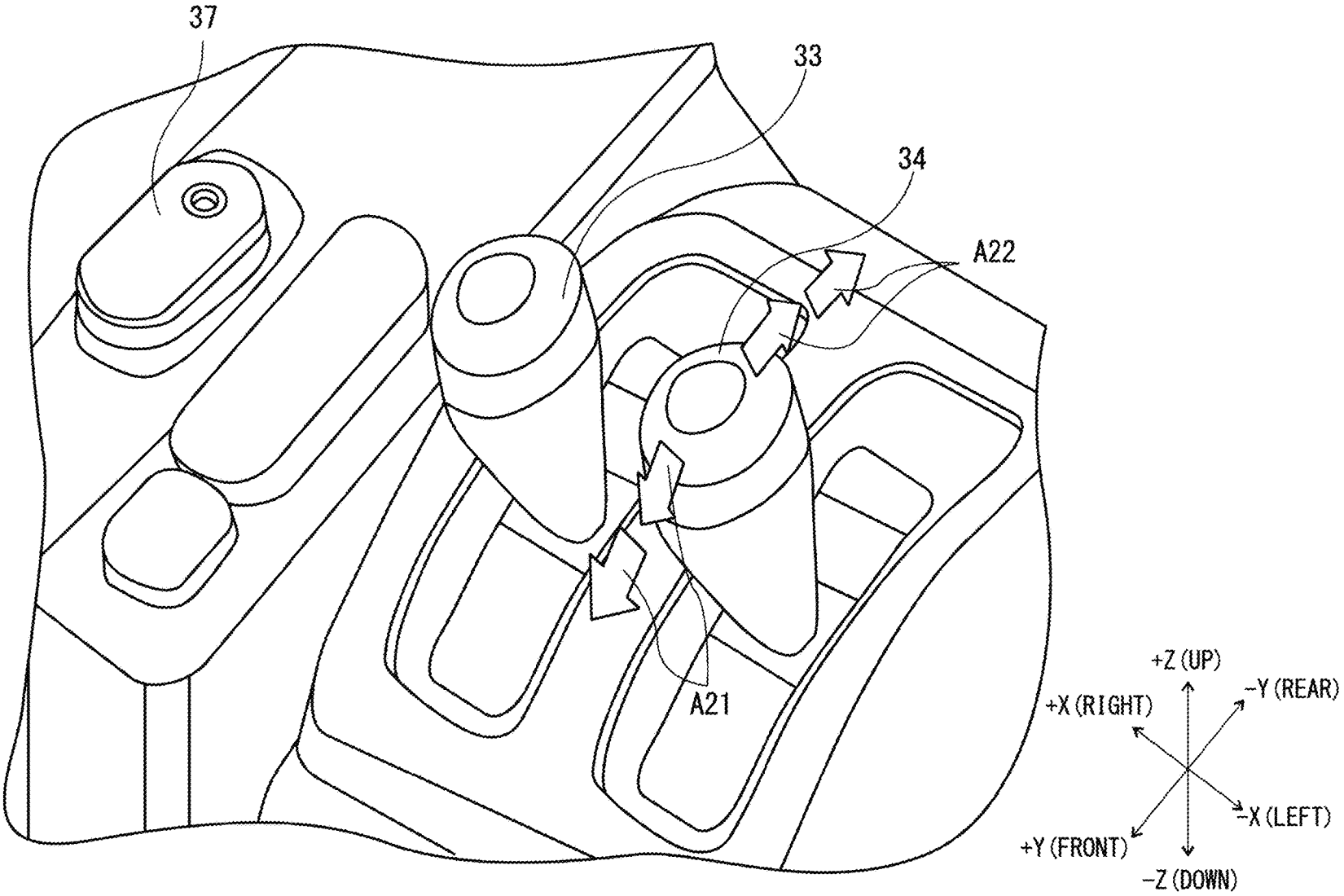
FIG. 3 A perspective view schematically showing a portion A1 shown in FIG. 2.
Figure 4:
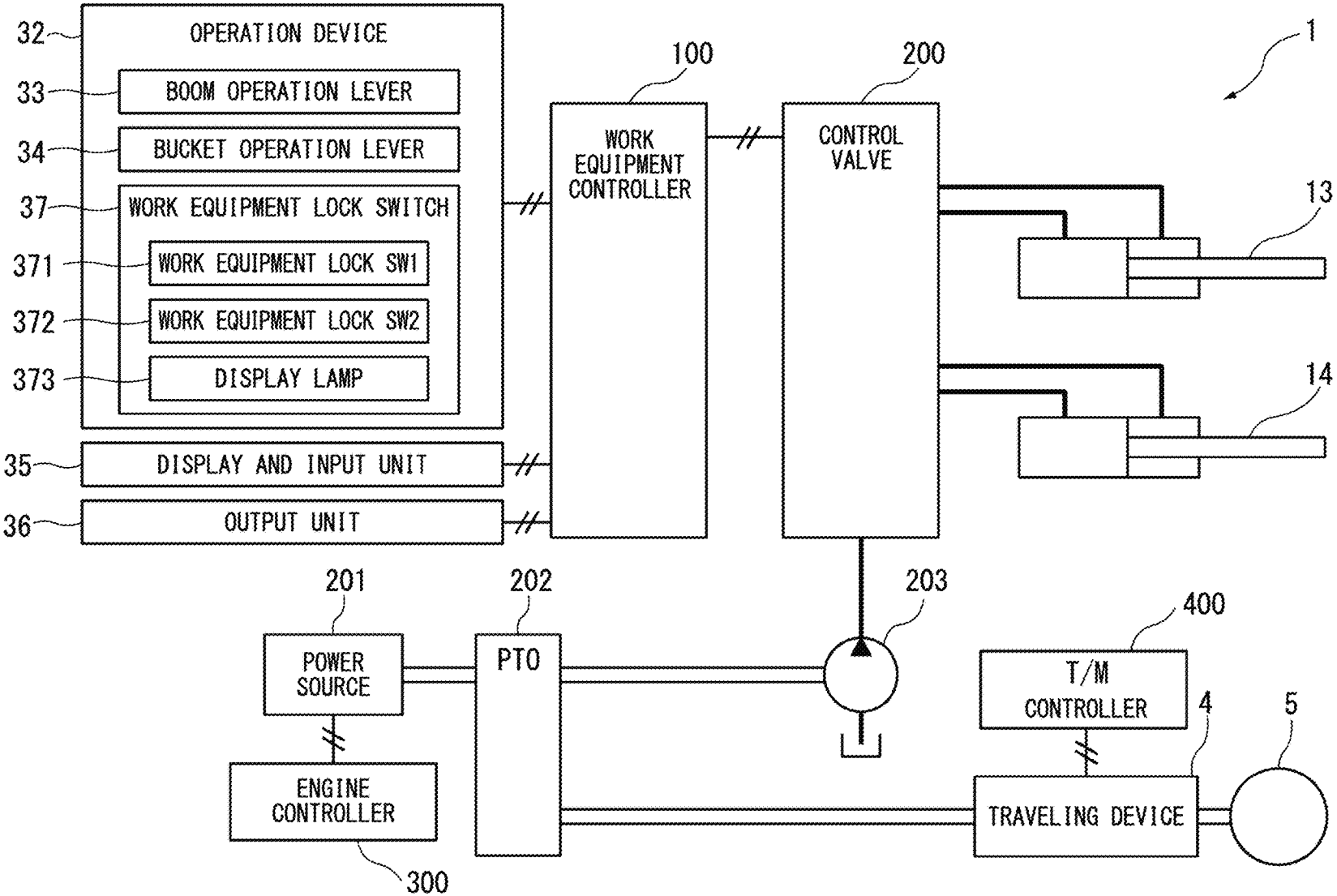
FIG. 4 A block diagram showing a configuration example of a control system of the work machine according to the embodiment of the present disclosure.
Figure 5:
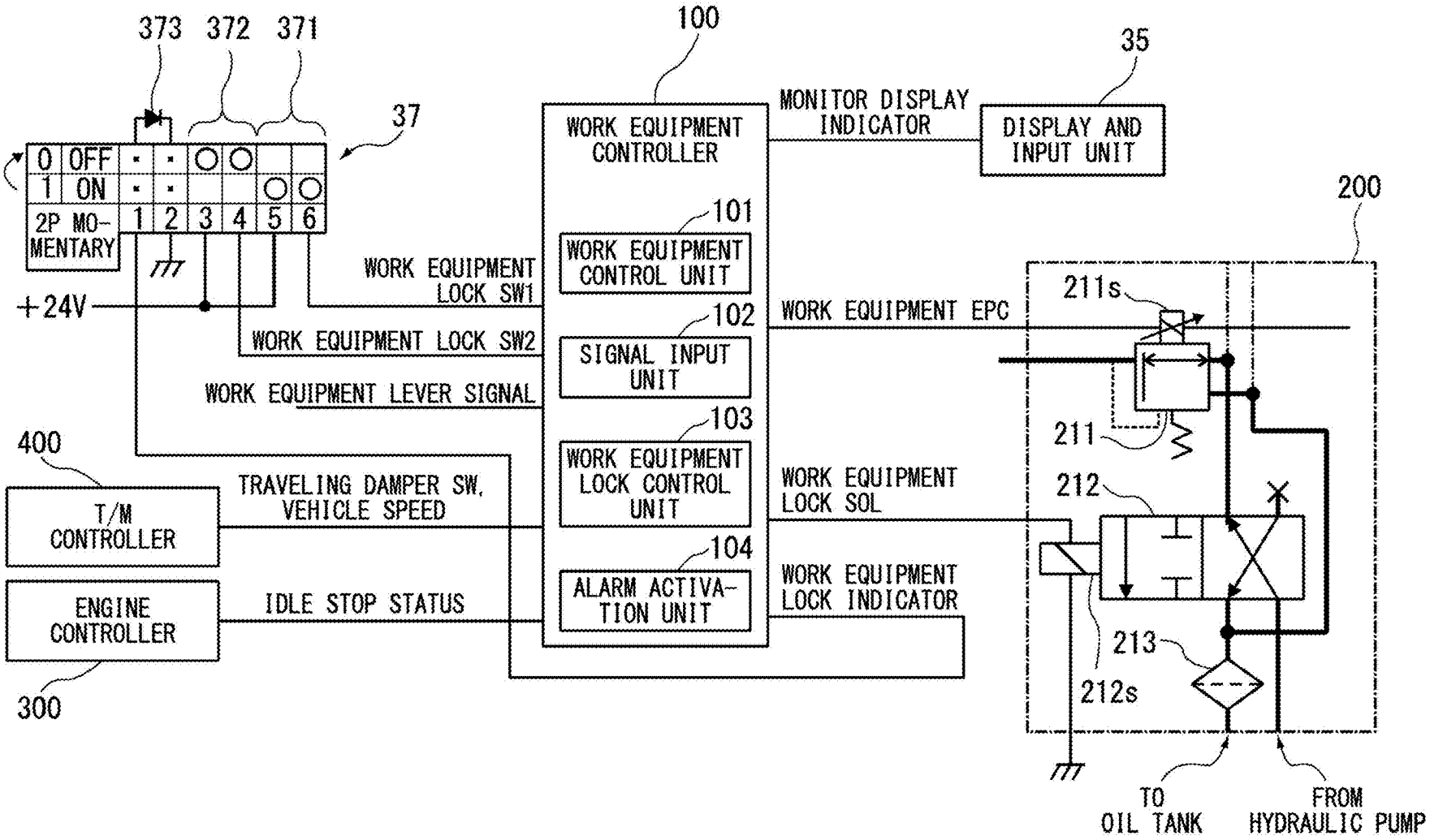
FIG. 5 A block diagram showing a configuration example of the control system of the work machine according to the embodiment of the present disclosure.
Figure 8:
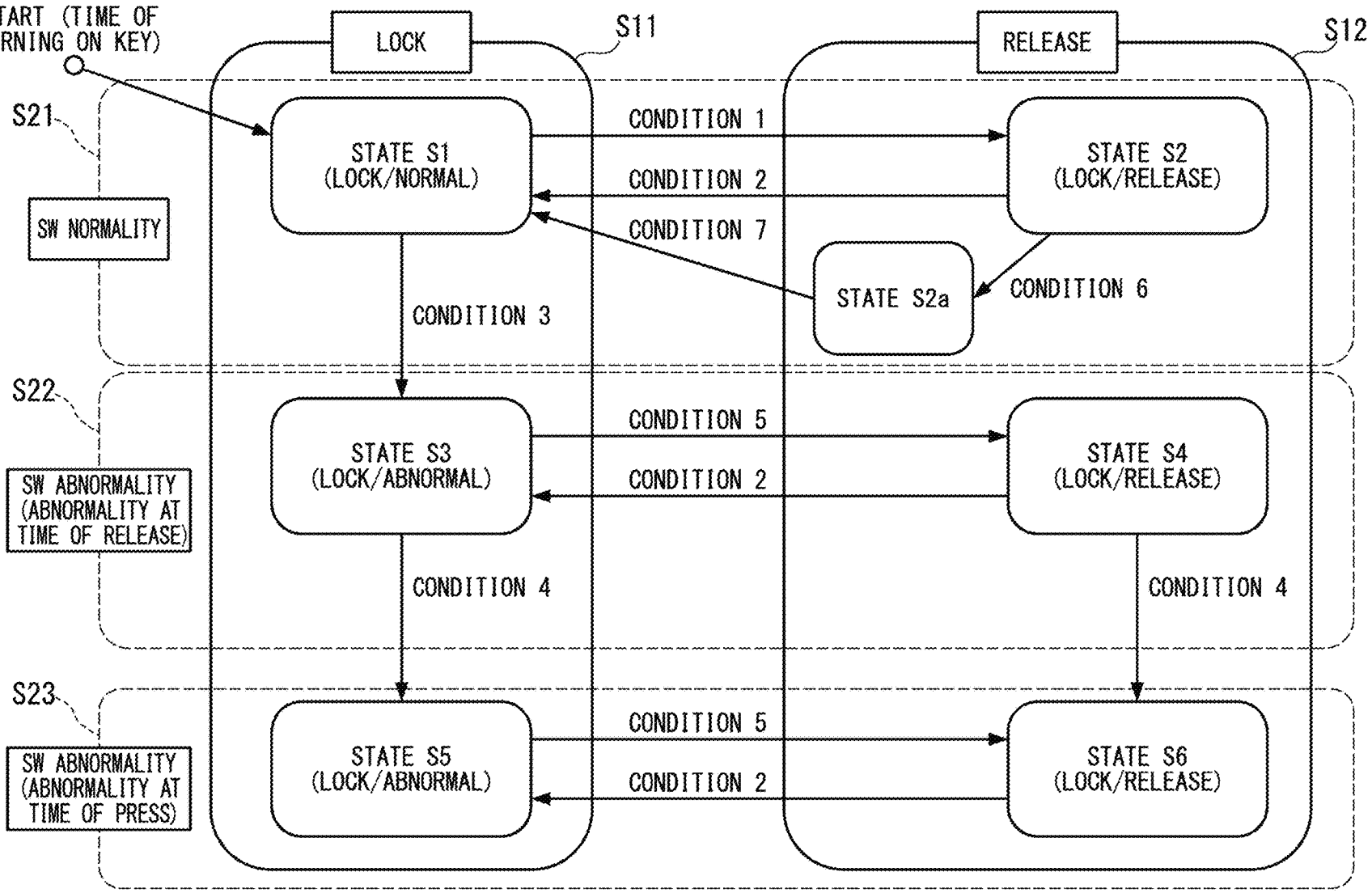
FIG. 8 A state transition diagram showing an operation example of the work equipment controller according to the embodiment of the present disclosure.
Figure 19:
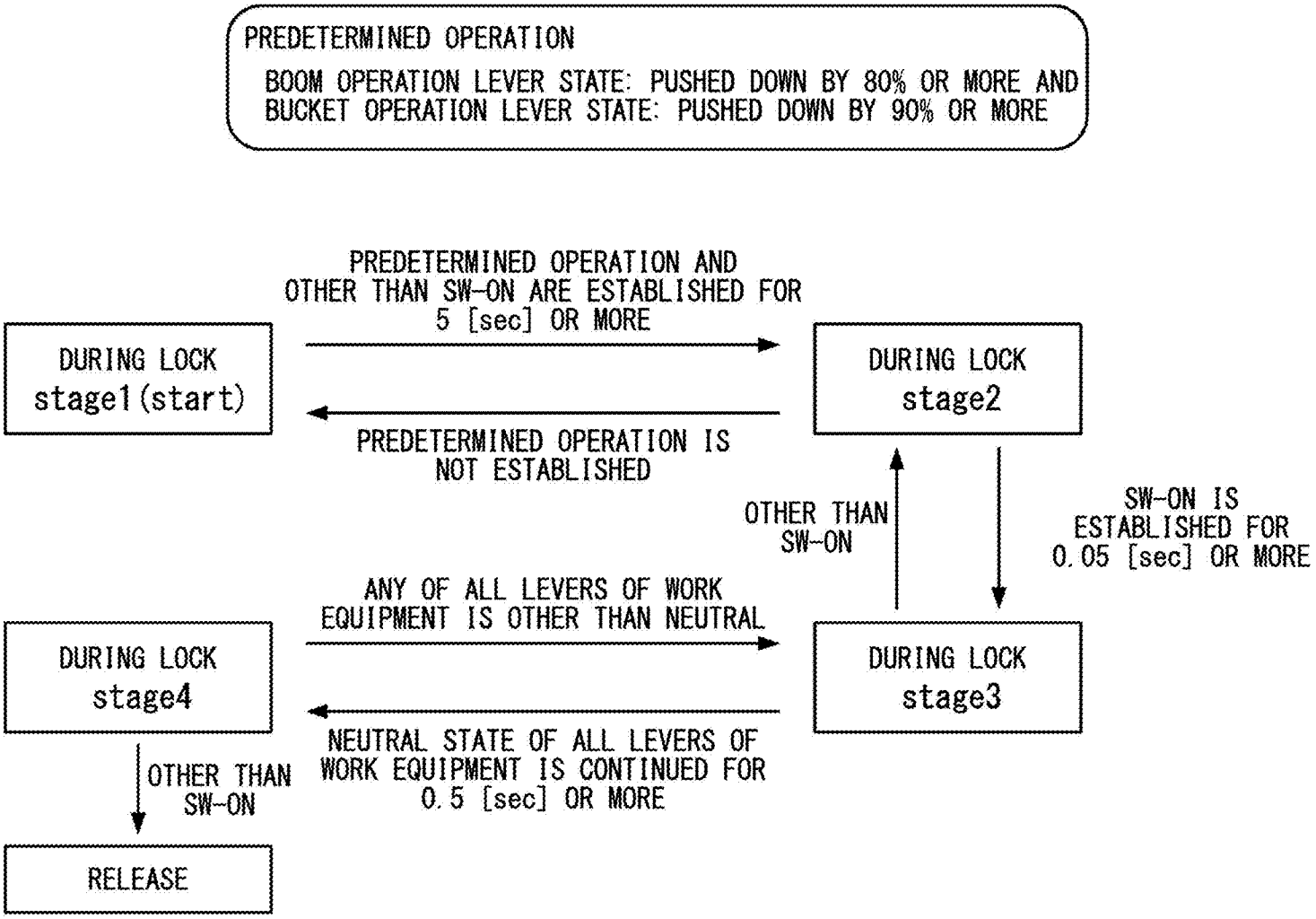
FIG. 19 A schematic diagram for describing an operation example of the work equipment controller according to the embodiment of the present disclosure.
Figure 20:
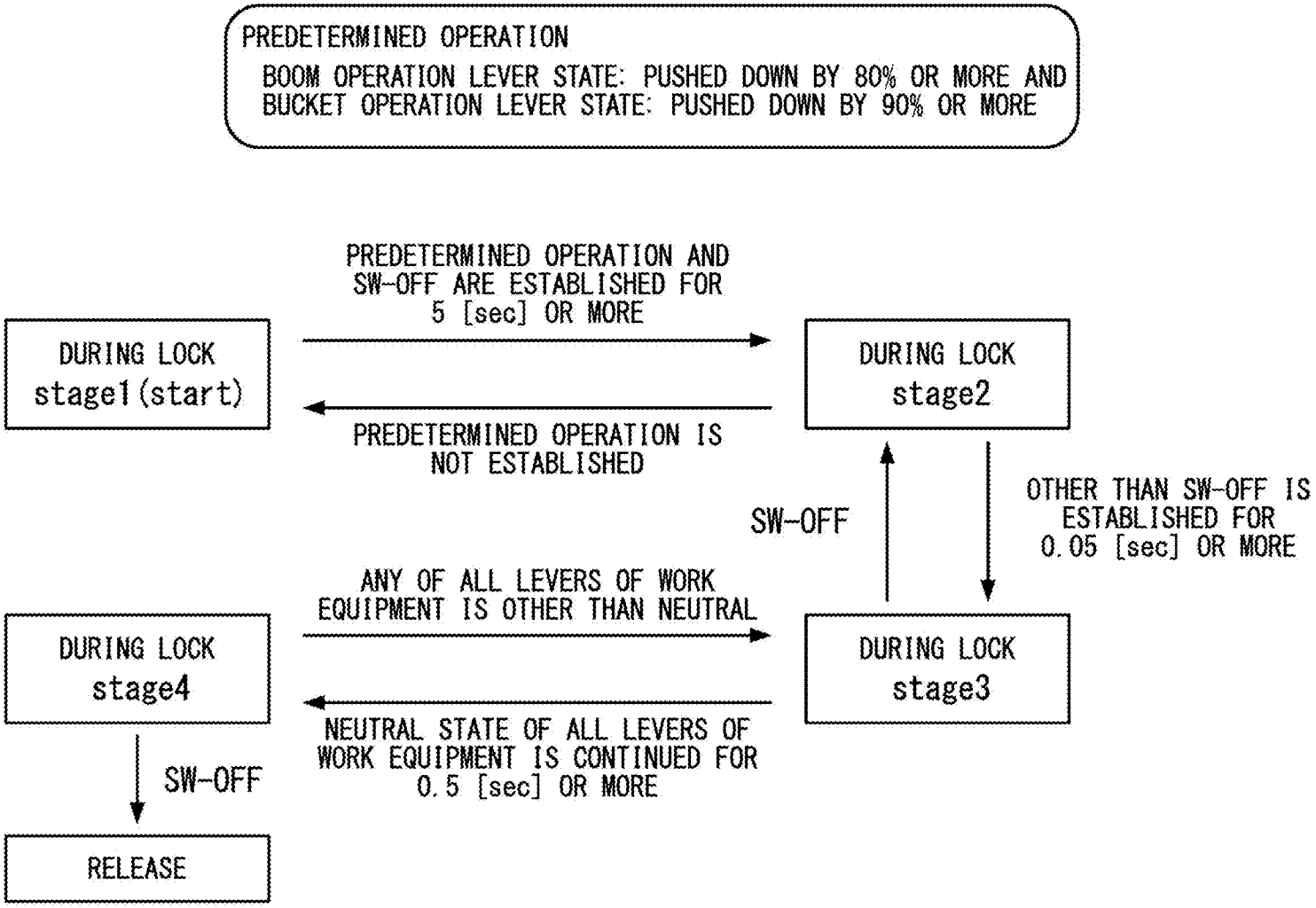
FIG. 20 A schematic diagram for describing an operation example of the work equipment controller according to the embodiment of the present disclosure.
Figure 21:
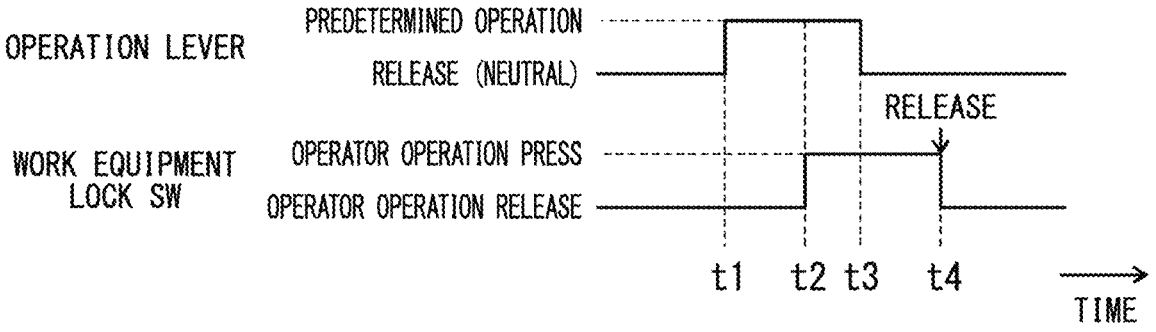
FIG. 21 A timing chart for describing an operation example of the work equipment controller according to the embodiment of the present disclosure.

Embodiments of the present disclosure will be described below with reference to the drawings. FIG. 1 is a side view showing a work machine according to an embodiment of the present disclosure. FIG. 2 is a perspective view schematically showing the periphery of a driver's seat according to the embodiment of the present disclosure. FIG. 3 is a perspective view schematically showing a portion A1 shown in FIG. 2. FIGS. 4 and 5 are block diagrams showing a configuration example of a control system of the work machine according to the embodiment of the present disclosure. FIGS. 6 and 7 are schematic diagrams for describing an operation example of the work equipment controller according to the embodiment of the present disclosure. FIG. 8 is a state transition diagram showing an operation example of a work equipment controller according to the embodiment of the present disclosure. FIGS. 9 to 20 are schematic diagrams for describing operation examples of the work equipment controller according to the embodiment of the present disclosure. FIG. 21 is a timing chart for describing an operation example of the work equipment controller according to the embodiment of the present disclosure. In addition, in each drawing, the same reference numerals are used for the same or corresponding components, and the description thereof will be omitted as appropriate.

As shown in FIG. 1, in the present embodiment, a local coordinate system is set in a work machine 1, and a positional relationship of each unit will be described with reference to the local coordinate system. In the local coordinate system, a first axis extending in a right-left direction (vehicle width direction) of the work machine 1 will be defined as an X-axis, a second axis extending in a front-rear direction of the work machine 1 will be defined as a Y-axis, and a third axis extending in an up-down direction of the work machine 1 will be defined as a Z-axis. The X-axis and the Y-axis are orthogonal to each other. The Y-axis and the Z-axis are orthogonal to each other. The Z-axis and the X-axis are orthogonal to each other. A +X-direction is the right direction, and a −X-direction is the left direction. A +Y-direction is the front direction, and a −Y-direction is the rear direction. A +Z-direction is the up direction, and a −Z-direction is the down direction.

Overview of Work Machine

FIG. 1 shows a work machine 1 according to the present embodiment. For example, the work machine 1 according to the present embodiment is a wheel loader. Hereinafter, the work machine 1 will be referred to as a wheel loader 1 as appropriate.

As shown in FIG. 1, the wheel loader 1 has a vehicle body 2, a cab 3, a traveling device 4, and work equipment 10. The wheel loader 1 travels on a work place by using the traveling device 4. In the work place, the wheel loader 1 carries out work by using the work equipment 10. The wheel loader 1 can use the work equipment 10 to carry out the work, such as excavation work, loading work, transport work, and snow removal work.

The cab 3 is supported by the vehicle body 2. Inside the cab 3, a driver's seat 31 on which an operator sits, an operation device 32 to be described later, a display and input unit 35, and an output unit 36 are disposed. The operation device 32 includes a boom operation lever 33, a bucket operation lever 34, and a work equipment lock switch 37.

The traveling device 4 includes, for example, a transmission, a drive shaft, a brake, and a rotatable wheel 5. The traveling device 4 includes, for example, a transmission that has a forward speed stage of 1 to 8 and a backward speed stage of 1 to 4. The smaller the number of the speed stage, the lower the speed. The wheels 5 support the vehicle body 2. The wheel loader 1 can travel on a road surface (or ground) RS by the traveling device 4. It should be noted that FIG. 1 shows only a front wheel 5F and a rear wheel 5R on a left side. The front wheel 5F may be driven by, for example, a hydraulic motor (not shown).

The work equipment 10 is supported by vehicle body 2. The work equipment 10 is configured by a bucket 12 as an example of a work tool, and a movable support section 17 that changes a position and a posture of the bucket 12. In the example shown in FIG. 1, the movable support section 17 includes a boom 11, a boom cylinder 13, a bucket cylinder 14, a bell crank 15, and a link 16.

The boom 11 is rotatably supported with respect to the vehicle body 2, and moves in the up-down direction according to expansion and contraction of the boom cylinder 13. The boom cylinder 13 is an actuator that generates power for moving the boom 11, and has one end portion connected to the vehicle body 2 and the other end portion connected to the boom 11. In a case where the operator operates the boom operation lever 33 (FIG. 3) included in the operation device 32, the boom cylinder 13 contracts and extends. As a result, the boom 11 moves in the up-down direction. The boom cylinder 13 is, for example, a hydraulic cylinder.

The bucket 12 is a container for an object such as earth, has bucket teeth 12T, and is a work tool for performing excavation of the object to be excavated such as earth or loading thereof. The bucket 12 is rotatably connected to the boom 11, and is rotatably connected to one end portion of the link 16. The other end portion of the link 16 is rotatably connected to one end portion of the bell crank 15. The bell crank 15 has a central portion connected to the boom 11 to be rotationally movable, and the other end portion rotatably connected to one end portion of the bucket cylinder 14. The other end portion of the bucket cylinder 14 is rotatably connected to the vehicle body 2. The bucket 12 is operated by power generated by the bucket cylinder 14. The bucket cylinder 14 is an actuator that generates power for moving the bucket 12. In a case where the operator operates the bucket operation lever 34 (FIG. 3), the bucket cylinder 14 is contracted and extended. As a result, the bucket 12 swings. The bucket cylinder 14 is, for example, a hydraulic cylinder. The bucket teeth 12T has a shape of chevron teeth, flat teeth, or the like, and is attached to an end portion of the bucket 12 to be replaceable.

[Configuration of Control System]

FIGS. 4 and 5 are block diagrams showing a configuration example of a control system of the wheel loader 1 according to the present embodiment. As shown in FIG. 4, the wheel loader 1 includes a power source 201, a power take off (PTO) 202, a hydraulic pump 203, a control valve 200, an operation device 32, a display and input unit 35, an output unit 36, a work equipment controller 100, an engine controller 300, and a transmission (T/M) controller 400.

The power source 201 generates a driving force for operating the work machine. An internal combustion engine and an electric motor are exemplary examples of the power source. In the present embodiment, it is assumed that the power source 201 is an internal combustion engine (engine).

The PTO 202 transmits at least a part of the driving force of the power source 201 to the hydraulic pump 203. The PTO 202 distributes the driving force of the power source 201 to the traveling device 4 and the hydraulic pump 203.

The hydraulic pump 203 is driven by the power source 201, and discharges a hydraulic oil. At least a part of the hydraulic oil discharged from the hydraulic pump 203 is supplied to each of the boom cylinder 13 and the bucket cylinder 14 via the control valve 200. The control valve 200 receives a predetermined control signal (work equipment EPC signal) from the work equipment controller 100 and controls the flow rate, the pressure, and the direction of the hydraulic oil supplied to each of the boom cylinder 13 and the bucket cylinder 14 from the hydraulic pump 203. The work equipment 10 is operated by the hydraulic oil from the hydraulic pump 203.

The operation device 32 is disposed inside the cab 3. The operation device 32 is operated by the operator. The operator operates the operation device 32 to adjust a traveling direction and a traveling speed of the wheel loader 1, switches between forward and rearward movement, and operates the work equipment 10. The operation device 32 includes, for example, a steering, a shift lever, an accelerator pedal, a brake pedal, a traveling damper switch, a boom operation lever 33, a bucket operation lever 34, and a work equipment lock switch 37.

FIGS. 2 and 3 show configuration examples of the boom operation lever 33, the bucket operation lever 34, and the work equipment lock switch 37 according to the present embodiment. The boom operation lever 33 and the bucket operation lever 34 may have the same configuration. FIG. 3 shows a case where tilt positions of the boom operation lever 33 and the bucket operation lever 34 are neutral positions. The bucket operation lever 34 is tilted in the front-rear direction around the neutral position as indicated by an arrow A21 and an arrow A22 in FIG. 3. Similarly, the boom operation lever 33 is tilted in the front-rear direction with the neutral position as a center. The boom operation lever 33 and the bucket operation lever 34 have a mechanism that automatically returns the position of the operation lever to the neutral position in a state where a certain or more operation force is not applied to the operation lever.

The boom operation lever 33 is an operation lever for operating the posture of the boom 11. In a case where the boom operation lever 33 is tilted in the rear direction, the boom 11 moves in the upward direction. In a case where the boom operation lever 33 is tilted in the front direction, the boom 11 moves in the downward direction. The movement speed is changed according to a tilt amount of the boom operation lever 33. The larger the tilt amount, the higher the speed. The bucket operation lever 34 is an operation lever for operating the posture of the bucket 12. In a case where the bucket operation lever 34 is tilted in the rear direction, the bucket 12 is moved in a tilt direction (a direction in which the bucket teeth 12T faces upward as shown in FIG. 1). In a case where the bucket operation lever 34 is tilted in the front direction, the bucket 12 is moved in a dump direction (direction in which the bucket teeth 12T shown in FIG. 1 faces downward). The movement speed is changed according to the tilt amount of the bucket operation lever 34. The larger the tilt amount, the higher the speed. The boom operation lever 33 and the bucket operation lever 34 include one or a plurality of stroke sensors therein, detect the tilt amount of the operation lever, and output a detection signal (work equipment lever signal in FIG. 5) indicating the detection result as an analog voltage value.

The work equipment lock switch 37 is a push button switch (push button according to the present disclosure) for setting and releasing the lock of the operation of the work equipment 10. The work equipment lock switch 37 is a momentary operation push button switch. That is, the work equipment lock switch 37 is turned on only while the button is being pressed by the hand or the like, and is returned to the off state in a case where the hand or the like is separated from the button. In addition, as shown in FIGS. 4 and 5, the work equipment lock switch 37 includes a work equipment lock switch (SW)1 (371) and a work equipment lock switch (SW)2 (372).

The work equipment lock SW1 (371) is a normally open switch (first switch according to the present disclosure) that detects the press and release of the work equipment lock switch 37. The work equipment lock SW1 (371) is turned on while the button is being pressed, and is turned off in a case where the button is released. The work equipment lock SW2 (372) is a normally closed switch (second switch according to the present disclosure) that detects the press and release of the work equipment lock switch 37 linked to the work equipment lock SW1 (371). The work equipment lock SW2 (372) is turned off while the button is being pressed, and is turned on in a case where the button is released.

In addition, the work equipment lock switch 37 includes a display lamp 373 consisting of a light emitting diode (LED). The display lamp 373 is controlled by the work equipment controller 100 to be turned on in a state where the work equipment 10 is not operated, that is, in a state where the operation of the work equipment 10 is locked (in the present embodiment, this state is also referred to as a state where the work equipment is set to be locked), and to be turned off in a state where the work equipment 10 can be operated, that is, in a state where the lock of the operation of the work equipment 10 is released.

In the present embodiment, a state where the work equipment lock switch 37 (push button) is pressed is referred to as ON, and a state where the work equipment lock switch 37 (push button) is released is referred to as OFF. In addition, the work equipment lock switch 37 may be simply referred to as "SW". For example, "SW normality" means a state in which the work equipment lock SW1 (371) and the work equipment lock SW2 (372) are normally operated. In addition, "SW abnormality" means a state in which the ground fault, power supply fault, or disconnection failure is generated in any of the work equipment lock SW1 (371) or the work equipment lock SW2 (372).

In addition, as shown in FIG. 5, one terminal of the work equipment lock SW1 (371) is connected to the DC power supply (24 V in the present embodiment), and the other terminal is connected to the work equipment controller 100. A signal line that connects the other terminal of the work equipment lock SW1 (371) to an input circuit (not shown) in the work equipment controller 100 is a first signal line, and a signal name on the first signal line is the work equipment lock SW1. One terminal of the work equipment lock SW2 (372) is connected to the DC power supply, and the other terminal is connected to the work equipment controller 100. A signal line that connects the other terminal of the work equipment lock SW2 (372) to an input circuit (not shown) in the work equipment controller 100 is a second signal line, and a signal name on the second signal line is the work equipment lock SW2. The first signal line and the second signal line are pulled down through a predetermined resistor in the work equipment controller 100.

In addition, an anode of an LED constituting the work equipment lock switch 37 is connected to an output terminal (signal name: work equipment lock indicator) of the work equipment controller 100, and a cathode is connected to the ground.

In addition, the display and input unit 35 shown in FIG. 4 is configured with a combination of an input device and a display device, an input display device such as a touch panel, and the like. The operator inputs, for example, a set value or the like in the control of the work equipment 10 or displays information indicating the content in a case where a failure or the like occurs, using the display and input unit 35. The display and input unit 35 displays predetermined information in response to the monitor display indicator signal received from the work equipment controller 100. In addition, the output unit 36 includes a display device, a synthetic voice, an output device of an alarm sound or a notification sound, a display lamp such as a warning lamp, and the like, and outputs predetermined information.

The engine controller 300 shown in FIG. 4 controls the power source 201 according to an operation of an accelerator pedal (not shown) provided in the operation device 32. In addition, the engine controller 300 has an auto-idle stop function of automatically stopping the engine in a case where the idling state is continued for an idling time set by the operator. As shown in FIG. 5, the engine controller 300 transmits an idle step status signal indicating whether or not the power source 201 is stopped by the auto-idle stop function, to the work equipment controller 100.

The T/M controller 400 shown in FIG. 4 controls a transmission (not shown) provided in the traveling device 4 according to an operation of a shift lever (not shown) provided in the operation device 32. In addition, as shown in FIG. 5, the T/M controller 400 transmits a signal (travel damper SW signal) indicating whether or not a traveling damper function is operating, a signal indicating the vehicle speed, a signal requesting the lock of the work equipment 10, and the like to the work equipment controller 100. The traveling damper function is a function of reducing the vibration caused by traveling by connecting the boom cylinder 13 to an accumulator (not shown) in the control valve 200 during traveling to control the pressure accumulation of the accumulator. In addition, the signal for requesting the lock of the work equipment 10 is generated, for example, in a case where it is necessary to give priority to the traveling side over the work of the work equipment 10 in a case where the work equipment 10 is traveling on a steep slope or the like.

The work equipment controller 100 is formed using, for example, a field programmable gate array (FPGA) or a microcomputer that includes a processor, a main storage device, an auxiliary storage device, an input/output device, and the like. The work equipment controller 100 includes, as a functional configuration constituted by hardware or a combination of hardware and software such as a program, a work equipment control unit 101, a signal input unit 102, a work equipment lock control unit 103, and an alarm activation unit 104. The work equipment controller 100 is an example of a control device according to the present disclosure.

The work equipment control unit 101 drives and controls the boom cylinder 13, the bucket cylinder 14, and the like by outputting a work equipment electric pressure control (EPC) signal in response to the work equipment lever signal and the like output from the operation device 32 and controlling the control valve 200. FIG. 5 shows a configuration of a part of the control valve 200. In addition, the work equipment EPC signal indicates one of the plurality of work equipment EPC signals. The pressure control valve 211 controls hydraulic oil supplied to the boom cylinder 13, the bucket cylinder 14, and the like by variably controlling an operation of a solenoid 211*s* according to the work equipment EPC signal.

In addition, the work equipment control unit 101 determines whether or not there is an abnormality in the work equipment lever according to the work equipment lever signal or the like output by the operation device 32. In a case where it is determined that there is the abnormality, the work equipment control unit 101 stops the drive of the work equipment 10 or implements the function restriction of limiting the drive speed of the work equipment 10.

The signal input unit 102 repeatedly inputs the work equipment lock SW1 signal and the work equipment lock SW2 signal, for example, at a predetermined cycle. That is, the signal input unit 102 inputs the work equipment lock SW1 signal from a signal line (referred to as a first signal line) connected to the normally open work equipment lock SW1 (first switch) 371 that detects the press and release of the work equipment lock switch 37, which is a momentary operation push button for setting and releasing the lock of the operation of the work equipment 10, and inputs the work equipment lock SW2 signal from a signal line (referred to as a second signal line) connected to the work equipment lock SW2 (second switch) 372 of the normally closed type linked to the work equipment lock SW1. That is, the work equipment controller 100 has a step of inputting a signal from the first signal line connected to the normally open first switch that detects the press and release of the momentary operation push button for setting and releasing the lock of the operation of the work equipment 10 and is connected to the first switch, and inputting the signal from the second signal line connected to the normally closed second switch linked to the first switch.

The work equipment lock control unit 103 outputs a work equipment lock solenoid (SOL) signal in response to the work equipment lock SW1 signal, the work equipment lock SW2 signal, and the like input from the work equipment lock switch 37, and turns on or off the direction control valve 212 to block or supply the hydraulic oil supplied to the boom cylinder 13, the bucket cylinder 14, and the like. For example, the work equipment lock SOL signal is turned on to apply a direct current of 24 V to a solenoid 212*s* of the direction control valve 212 to block the hydraulic oil, and the work equipment lock SOL signal is turned off to be the open state to supply the hydraulic oil. Here, the state in which the hydraulic oil is blocked is a state in which the work equipment 10 is locked (state in which the lock is set), and the state in which the hydraulic oil is supplied is a state in which the lock of the work equipment 10 is released.

In a case where information indicating that the work equipment lock switch 37 (push button) is OFF→ON→OFF is obtained from both of the first signal line and the second signal line, the work equipment lock control unit 103 alternately switches between setting and releasing the lock of the operation of the work equipment 10, and in a case where information indicating that the work equipment lock switch 37 (push button) is OFF→ON→OFF is obtained from only one of the first signal line and the second signal line, the work equipment lock control unit 103 releases the lock of the operation of the work equipment 10 only when a predetermined operation is performed on a predetermined operation device 32 of the work equipment 10 when the lock of the operation of the work equipment 10 is set. The predetermined operation can include, for example, an operation by a combination of predetermined operations for a plurality of operation levers included in the operation device 32. The predetermined operation can include, for example, an operation of simultaneously performing an operation of driving the bucket 12 at a predetermined speed or more in the dump direction with respect to the bucket operation lever 34 for driving the bucket 12 in the dump direction and the tilt direction and an operation of driving the boom 11 at the predetermined speed or more in the lowering direction with respect to the boom operation lever 33 for driving the boom 11 in the up-down direction. That is, in a case where information indicating that the push button is OFF→ON→OFF is obtained from both of the first signal line and the second signal line, the work equipment controller 100 has a step of alternately switching the setting and the release of the lock of the operation of the work equipment 10, and in a case where information indicating that the push button is OFF→ON→OFF is obtained from only one of the first signal line and the second signal line, the work equipment controller 100 has a step of releasing the lock of the operation of the work equipment 10 only in a case where a predetermined operation is performed on a predetermined operation device of the work equipment 10 when the lock of the operation of the work equipment 10 is set.

In a case where the work equipment lock switch 37 is not OFF→ON→OFF in a state where the lock of the work equipment 10 is released, when a predetermined condition for automatically setting the lock of the work equipment 10 is established, the work equipment lock control unit 103 sets the lock of the work equipment 10 when the work equipment 10 is controlled to be in a stop state. In a case where the lock of the work equipment 10 is automatically locked (set to the lock) from the release without the operation of the operator, the lock is set when the work equipment 10 is controlled to be in the stop state. According to this configuration, it is possible to prevent the work equipment 10 from being suddenly stopped when the automatic locking is performed, and for example, it is possible to prevent a large forward fall or an impact from being generated.

In a case where information indicating the occurrence of a predetermined failure is obtained from the first signal line or the second signal line, the alarm activation unit 104 reports that fact to the display and input unit 35, the output unit 36, and the like.

Operation Example of Work Equipment Controller

Basic Example of Failure Determination and Processing in Case of Failure Occurrence First, with reference to FIGS. 6 to 9, the operation determination of turning on or off the work equipment lock switch 37 based on the work equipment lock SW1 signal and the work equipment lock SW2 signal and the determination of whether or not there is an abnormality (hereinafter, referred to as an abnormality determination) will be described. FIG. 6 shows a correspondence relationship between a combination of a state of "Hi" (high level) or "Lo" (low level) of the work equipment lock SW1 signal and a state of "Hi" or "Lo" of the work equipment lock SW2 signal, and results of the operation determination and the abnormality determination. In a normal case, one of the work equipment lock SW1 signal and the work equipment lock SW2 signal is "Hi", and the other is "Lo". In addition, a case where both of the work equipment lock SW1 signal and the work equipment lock SW2 signal are "Hi" ("abnormal Hi") or both of the work equipment lock SW1 signal and the work equipment lock SW2 signal are "Lo" ("abnormal Lo") is an abnormal case.

FIG. 7 shows the classification of the operation states based on the work equipment lock SW1 signal and the work equipment lock SW2 signal as the operation states A to E. FIG. 7 shows a correspondence relationship among the normal or abnormal states, whether or not it is in a normal state and the content of the abnormality when the state is the abnormal state, a time-series signal (the work equipment lock SW1 signal and the work equipment lock SW2 signal) when the operator performs the normal ON/OFF switching operation (the operation of pressing and releasing the work equipment lock switch 37), a state recognition of the work equipment lock switch 37 of the work equipment controller 100, the presence or absence of the error report by the alarm activation unit 104, and the processing contents of whether or not the work equipment lock control unit 103 executes the switching between the setting and the release of the lock state, in the operation states A to E.

The operation state A is an SW normality and is normal, and with respect to "release"→"press"→"release" of the SW, the work equipment lock SW1 signal of normally open (N.O.) is set to "Lo"→"Hi"→"Lo", and the work equipment lock SW2 signal of normally closed (N.C.) is set to "Hi"→"Lo"→"Hi". In addition, the state recognition is "OFF"→"ON"→"OFF". However, since chattering occurs at the time of switching of the switch, the actual signal is "abnormal Hi" or "abnormal Lo" for a short time. In this case, the error report is not performed, and switching between the release and setting of the lock is executed.

The operation state B is an SW abnormality (abnormality at the time of press), and the content of the abnormality is disconnection or a ground failure of the normally open work equipment lock SW1 (371). With respect to "release"→"press"→"release" of the SW, the work equipment lock SW1 signal of normal open (N.O.) is fixed to "Lo", and the work equipment lock SW2 signal of normal close (N.C.) is set to "Hi"→"Lo"→"Hi". Further, the state recognition is "OFF"→"abnormal Lo"→"OFF". In this case, the error report is performed, and the switching between the release and setting of the lock is executed.

The abnormality at the time of press is an abnormality that can be detected in a state where the work equipment lock switch 37 is pressed. In addition, the abnormality at the time of release is an abnormality that can be detected in a state where the work equipment lock switch 37 is released.

The operation state C is an SW abnormality (abnormality at the time of release), and the content of the abnormality is a power supply failure of the normally open work equipment lock SW1 (371). With respect to "release"→"press"→"release" of the SW, the work equipment lock SW1 signal of normal open (N.O.) is fixed to "Hi", and the work equipment lock SW2 signal of normal close (N.C.) is set to "Hi"→"Lo"→"Hi". Further, the state recognition is "abnormal Hi"→"ON"→"abnormal Hi". In this case, the error report is performed, and the switching between the release and setting of the lock is executed.

The operation state D is the SW abnormality (abnormality at the time of release), and the content of the abnormality is a ground fault or disconnection failure of the normally closed work equipment lock SW2 (372). With respect to "release"→"press"→"release" of the SW, the work equipment lock SW1 signal of normal open (N.O.) is set to "Lo"→"Hi"→"Lo", and the work equipment lock SW2 signal of normal close (N.C.) is fixed to "Lo". Further, the state recognition is "abnormal Lo"→"ON"→"abnormal Lo". In this case, the error report is performed, and the switching between the release and setting of the lock is executed.

The operation state E is the SW abnormality (abnormality at the time of press), and the content of the abnormality is a power supply failure of the normally closed work equipment lock SW2 (372). With respect to "release"→"press"→"release" of the SW, the work equipment lock SW1 signal of normal open (N.O.) is "Lo"→"Hi"→"Lo", and the work equipment lock SW2 signal of normal close (N.C.) is fixed to "Hi". Further, the state recognition is "OFF"→"abnormal Hi"→"OFF". In this case, the error report is performed, and the switching between the release and setting of the lock is executed.

As described with reference to FIG. 7, even in a case where a failure occurs in any of the two switches for detecting the press and release of the work equipment lock switch 37, when the work equipment lock switch 37 is operated in the order of "release" →"press"→"release", the operation of "release"→"press"→"release" can be detected from the state at the time of "press" and the state before and after "press". Therefore, the setting and release of the lock of the work equipment 10 can be performed according to the intention of the operator. In addition, in a case where the occurrence of an abnormality is detected, the operator or the like can be notified that repair is necessary by reporting that fact. Therefore, it is possible to prevent further progress of the failure.

It should be noted that the determination of whether or not to execute the switching between the setting and the release of the lock state is not limited to being performed based on only the operation state of the work equipment lock switch 37, and can be performed, for example, in consideration of another operation state or the like of the work machine 1. Examples thereof will be described below.

Detailed Example of Failure Determination and Processing in Case of Failure Occurrence An operation example of the work equipment lock control unit 103 will be described with reference to a state transition diagram of the work equipment lock state shown in FIG. 8. FIGS. 9 to 20 show examples of transition conditions of states in the state transition diagram shown in FIG. 8. The initial state is a time of start of the work machine 1 (a time of turning on the key), and the initial state after the start is a state S1.

A state transition diagram shown in FIG. 8 includes states S1, S2, S2*a*, S3, S4, S5, and S6. Each of the states S1 to S6 is classified into one of the lock state (set state) S11 or the release state S12. The states S1, S3, and S5 belong to the lock state S11, and in the states S1, S3, and S5, the work equipment lock control unit 103 locks the work equipment 10. In addition, the state S2, the state S2*a*, the state S4, and the state S6 belong to the release state S12, and in the state S2, the state S2*a*, the state S4, and the state S6, the work equipment lock control unit 103 releases the lock of the work equipment 10.

In addition, each of the states S1 to S6 is classified into any of a SW normal state S21, a SW abnormal (abnormal at the time of release) state S22, or a SW abnormal (abnormal at the time of press) state S23. The SW normal state S21 includes the state S1, the state S2, and the state S2*a*. The SW abnormal (abnormal at the time of release) state S22 includes the state S3 and the state S4. The SW abnormal (abnormal at the time of press) state S23 includes the state S5 and the state S6.

In a case where a condition 1 is established in the state S1, the state transitions to the state S2. In a case where a condition 3 is established in the state S1, the state transitions to the state S3. In a case where a condition 2 is established in the state S2, the state transitions to the state S1. In a case where a condition 6 is established in the state S2, the state transitions to a state S2*a*. In a case where a condition 7 is established in the state S2*a*, the state transitions to the state S1.

In addition, in a case where a condition 5 is established in the state S3, the state transitions to the state S4. In a case where a condition 4 is established in the state S3, the state transitions to a state S5. In a case where the condition 2 is established in the state S4, the state transitions to the state S3. In a case where the condition 4 is established in the state S4, the state transitions to the state S6.

In addition, in a case where the condition 5 is established in the state S5, the state transitions to the state S6. In a case where the condition 2 is established in the state S6, the state transitions to the state S5.

FIGS. 9 to 15 show examples of the contents of the conditions 1 to 7 shown in FIG. 8. FIGS. 16 to 18 show examples of conditions of switching determination, conditions of long press determination, the SW press condition, and SW release conditions, which are conditions including some of the conditions 1 to 7. In addition, FIG. 19 shows an example of the content of the switching determination accompanied by the predetermined operation shown in FIG. 17. In addition, FIG. 20 shows an example of the content of the switching determination accompanied by the predetermined operation shown in FIG. 18.

Figure 9:
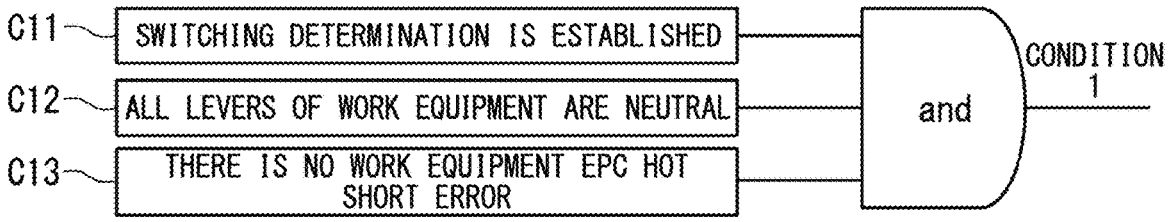
FIG. 9 A schematic diagram for describing an operation example of the work equipment controller according to the embodiment of the present disclosure.

As shown in FIG. 9, the condition 1 is established in which the switching determination is established (C11), all levers of the work equipment are neutral (C12), and there is no work equipment EPC hot short error (C13). The switching determination is established (C11) in a case where the last transition of "OFF"→"ON" continued for 0.05 [sec] or more→"OFF" of the work equipment lock switch 37 of the switching determination corresponding to the state S1 <lock→release> is established, as shown in FIG. 16. In addition, there is no work equipment EPC hot short error (C13) means that the output terminal of the work equipment EPC signal does not have a power supply failure or a short circuit failure. The condition 1 is a logical product (AND) of the conditions C11 to C13.

Figure 10:
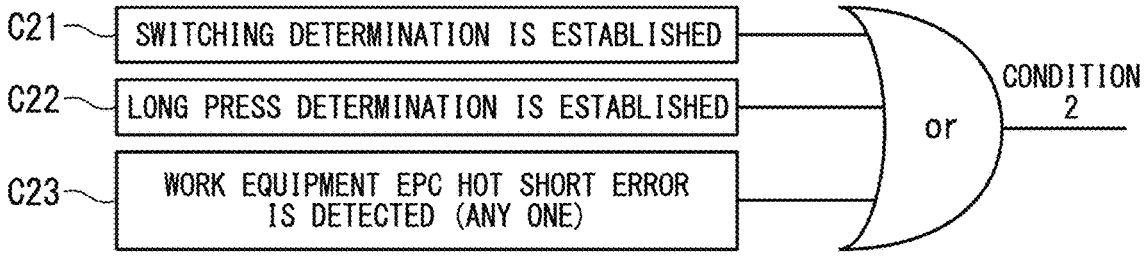
FIG. 10 A schematic diagram for describing an operation example of the work equipment controller according to the embodiment of the present disclosure.

As shown in FIG. 10, the condition 2 is established in which the switching determination is established (C21), the long press determination is established (C22), or the work equipment EPC hot short error is detected (any one is detected) (C23). The condition 2 is a logical sum (OR) of the condition C21 to the condition C23. With respect to the establishment (C21) of the switching determination, the switching determination corresponding to the state S2 <release→lock> is as shown in FIG. 16, the switching determination corresponding to the state S4 <release→lock> is as shown in FIG. 17, and the switching determination corresponding to the state S6 <release→lock> is as shown in FIG. 18. The switching determination corresponding to the state S2 <release→lock> shown in FIG. 16 is established in a case where the last transition of "OFF"→"ON" continued for 0.05 [sec] or more→"OFF" of the work equipment lock switch 37 is established. The switching determination corresponding to the state S4 <release→lock> shown in FIG. 17 is established in a case where the last transition of other than "ON"→"ON" continued for 0.05 [sec] or more→other than "ON" of the work equipment lock switch 37 is established. The switching determination corresponding to the state S6 <release→lock> shown in FIG. 18 is established in a case where the last transition of "OFF"→other than "OFF" continued for 0.05 [sec] or more→"OFF" of the work equipment lock switch 37 is established.

Further, with respect to the establishment (C22) of the long press determination, the long press determination corresponding to the state S2 <release→lock> is as shown in FIG. 16, the long press determination corresponding to the state S4 <release→lock> is as shown in FIG. 17, and the long press determination corresponding to the state S6 <release→lock> is as shown in FIG. 18. The long press determination corresponding to the state S2 <release→lock> shown in FIG. 16 is established in a case where the "OFF"→"ON" continued for 0.5 [sec] or more of the work equipment lock switch 37 is established. The long press determination corresponding to the state S4 <release→lock> shown in FIG. 17 is established in a case where other than "ON"→"ON" continued for 0.5 [sec] or more of the work equipment lock switch 37 is established. The long press determination corresponding to the state S6 <release→lock> shown in FIG. 18 is established in a case where "OFF"→other than "OFF" continued for 0.5 [sec] or more of the work equipment lock switch 37 is established.

Since the condition 2 includes the establishment of the long press determination (C22) in addition to the establishment of the switching determination (C21), the operation of the work equipment lock switch 37 limited to a case where the switching determination is established (C11) in the condition 1 includes the long press operation.

Figure 11:
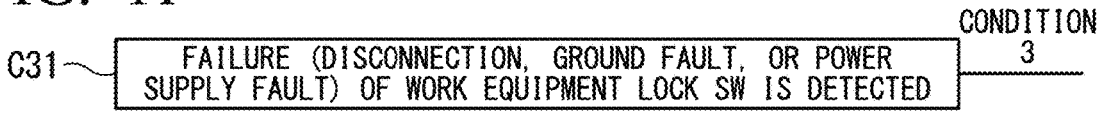
FIG. 11 A schematic diagram for describing an operation example of the work equipment controller according to the embodiment of the present disclosure.

As shown in FIG. 11, the condition 3 is that the failure (disconnection, ground fault, or power supply fault) of the work equipment lock switch 37 is detected (C31).

Figure 12:
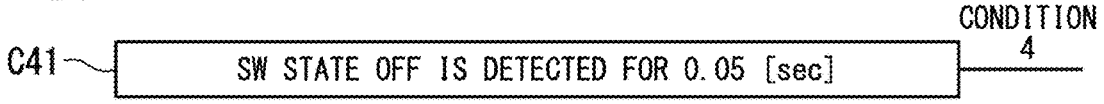
FIG. 12 A schematic diagram for describing an operation example of the work equipment controller according to the embodiment of the present disclosure.

As shown in FIG. 12, the condition 4 is that the SW state OFF is detected (C41) for 0.05 [sec]. The condition 4 is a condition for determining whether or not the abnormality is the abnormality at the time of press.

Figure 13:
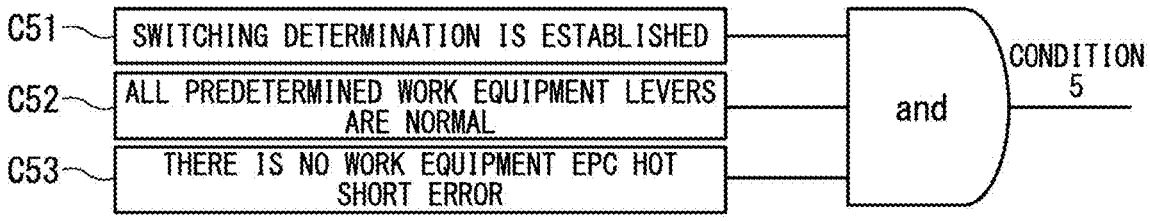
FIG. 13 A schematic diagram for describing an operation example of the work equipment controller according to the embodiment of the present disclosure.

As shown in FIG. 13, the condition 5 is established in a case where the switching determination is established (C51), all the predetermined work equipment levers (for example, the boom operation lever 33 and the bucket operation lever 34) are normal (C52), and there is no work equipment EPC hot short error (C53). The establishment (C51) of the switching determination is the condition of the switching determination shown in FIG. 19 corresponding to the state S3 <lock→release> shown in FIG. 17 or the condition of the switching determination shown in FIG. 20 corresponding to the state S5 <lock→release> shown in FIG. 18.

The condition of the switching determination shown in FIG. 19 is established in a case where the transition of a stage 1→a stage 2→a stage 3→a stage 4→"release" is made. The transition from the stage 1 to the stage 2 is made in a case where the condition in which the predetermined operation is performed and other than ON of the work equipment lock switch 37 is 5 [sec] or more is established. The predetermined operation is an operation in which the tilt amount of the boom operation lever 33 in the front direction is 80% or more of the full stroke and the tilt amount of the bucket operation lever 34 in the front direction is 90% or more of the full stroke. In a case where the boom operation lever 33 is pushed down in the front direction by 80% or more, the bucket operation lever 34 is pushed down in the front direction by 90% or more, and the state where the work equipment lock switch 37 is not pressed is continued for 5 seconds or more, the transition from the stage 1 to the stage 2 is performed. In a case where the predetermined operation is not established in the stage 2, the transition is made from the stage 2 to the stage 1.

In the stage 2, in a case where the state where the work equipment lock switch 37 is pressed is continued for 0.05 seconds or more, the transition to the stage 3 is performed. In a case where the work equipment lock switch 37 is other than ON in the stage 3, the transition to the stage 2 is performed.

In a case where a state in which all levers of the work equipment are neutral in the stage 3 is continued for 0.5 seconds or more, the transition to stage 4 is performed. In a case where the work equipment lock switch 37 is other than ON in the stage 4, the lock of the work equipment 10 is released. In a case where any of all levers of the work equipment is other than neutral in stage 4, the control proceeds to stage 3.

As shown in FIG. 21, in the condition shown in FIG. 19, a predetermined operation is started at time t1 from a state where the operation lever is neutral and the operator releases the work equipment lock switch 37 (operator operation release), the work equipment lock switch 37 is pressed by the operator at time t2 when the predetermined operation is continued (operator operation press), the operation lever is neutral at time t3 when the state where the work equipment lock switch 37 is pressed by the operator is continued, and thereafter, the lock is released at time t4 when the work equipment lock switch 37 is released by the operator. Since the return condition from each stage is set under the condition shown in FIG. 19, the order in which each condition is established is also defined as shown in FIG. 21.

The condition for the switching determination shown in FIG. 20 is established in a case where the transition is made from the stage 1 to the stage 2 to the stage 3 to the stage 4 to the "release". The transition from the stage 1 to the stage 2 is made in a case where the predetermined operation is performed and the condition that the work equipment lock switch 37 is OFF for 5 [sec] or more is established. The predetermined operation is the same as the predetermined operation described with reference to FIG. 19. In a case where the predetermined operation is not established in the stage 2, the transition is made from the stage 2 to the stage 1.

In the stage 2, in a case where the work equipment lock switch 37 is other than OFF and is continued for 0.05 seconds or more, the transition to the stage 3 is performed. In a case where the work equipment lock switch 37 is OFF in the stage 3, the transition to the stage 2 is performed.

In a case where a state in which all levers of the work equipment are neutral in the stage 3 is continued for 0.5 seconds or more, the transition to stage 4 is performed. In a case where the work equipment lock switch 37 is OFF in the stage 4, the lock of the work equipment 10 is released. In a case where any of all levers of the work equipment is other than neutral in stage 4, the control proceeds to stage 3.

The conditions shown in FIG. 20 are also defined in the same manner as the conditions shown in FIG. 19 in terms of the order in which each condition is established.

Figure 14:
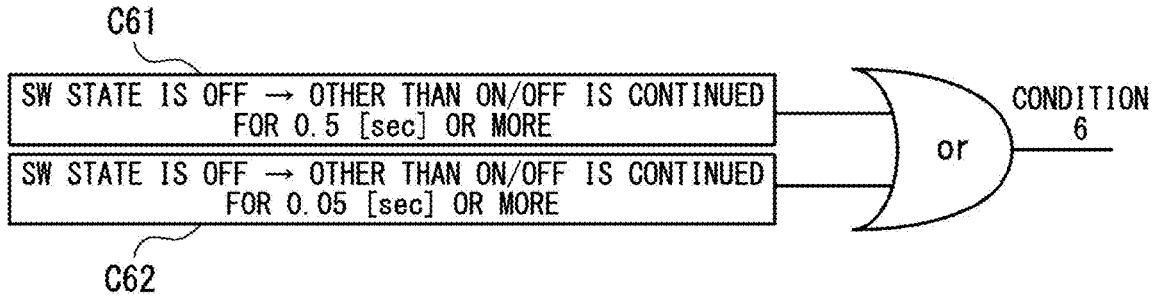
FIG. 14 A schematic diagram for describing an operation example of the work equipment controller according to the embodiment of the present disclosure.

Meanwhile, as shown in FIG. 14, the condition 6 is established in which the SW state is OFF→other than ON/OFF is continued for 0.5 [sec] or more (C61), or the SW state is OFF→other than ON/OFF is continued for 0.05 [sec] or more (C62).

Figure 15:
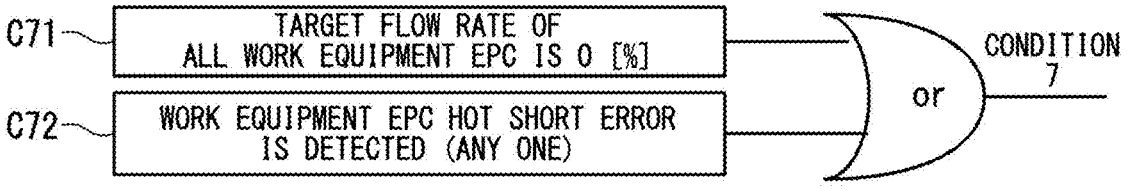
FIG. 15 A schematic diagram for describing an operation example of the work equipment controller according to the embodiment of the present disclosure.

As shown in FIG. 15, the condition 7 is established in which a target flow rate of all the work equipment EPC is 0 [%] (C71) or the work equipment EPC hot short error is detected (any one) (C72). The condition 7 is a condition that the work equipment 10 is stopped or control for stopping the work equipment 10 is performed.

The state S2*a* is a state of a preparation stage in a case where the work equipment 10 is automatically locked (the lock is automatically set) from a state where the lock of the work equipment 10 is released. In a state where the lock of the work equipment 10 is released, the work equipment 10 can be operated. Therefore, depending on the timing at which the work equipment 10 is locked, the operation of the work equipment 10 is suddenly stopped, and for example, there is a possibility that the balance of the work machine 1 is inappropriate. Therefore, in a case where the condition (condition 6) under which the lock is automatically performed is established, the state is once transitioned to the state S2*a* from the state S2, and the state is further transitioned to the state 1 when the condition 7 is established, so that the work equipment 10 is safely locked.

Actions and Effects

According to the present embodiment, it is possible to improve safety in the configuration for locking the operation of the work equipment by multiplexing two systems of switches that detect the operation of providing the instruction to switch between the setting and the release of the lock of the work equipment 10. In addition, even in a case where one of the switches to be detected is failed, the operation of instructing the operator to switch can be detected by the operation of the normal switch, so that the lock can be released and the emergency operability is not deteriorated. Further, in a case where the switch is failed, the operation of releasing the lock is added under a condition that a predetermined operation is accompanied with the operation of the switch on the operation device 32. Therefore, it is possible to ensure safety by reducing the possibility of unintentional release even in a case where one system fails.

Modification Example or Other Embodiments of Present Embodiment

Although the embodiments of the present invention have been described above in detail with reference to the drawings, the specific configuration is not limited to the above embodiments, and design modifications and the like are included within the scope of the gist of the present invention. Furthermore, some or all of the programs executed by the computer in the above embodiments can be distributed via a computer-readable recording medium or a communication line.

For example, the wheel loader 1 may be remotely operable. In this case, a part or all of the work equipment controller 100 and the operation device 32 can be provided, for example, at a place in which the remote operation is performed.

In addition, for example, the work machine (or work vehicle) is not limited to the wheel loader. For example, another work machine such as a hydraulic excavator can be used. In addition, the work tool is not limited to the bucket. The work tool may be, for example, a fork, a bale grab, or the like that is attached to the wheel loader to be replaceable, as an attachment.

Additional Notes

The work equipment controller 100 (control device) described in the above embodiment is understood as follows, for example.

(1) A control device (work equipment controller 100) is a control device of a work machine 1 including work equipment 10, and the control device includes: a signal input unit 102 configured to input a signal from a first signal line connected to a normally open first switch (work equipment lock SW1 (371)) configured to detect press and release of a momentary operation push button (work equipment lock switch 37) for setting and releasing lock of an operation of the work equipment, and input a signal from a second signal line connected to a normally closed second switch (work equipment lock SW2 (372)) linked to the first switch (hereinafter, a state where the push button is pressed is referred to as ON, and a state where the push button is released is referred to as OFF); and a work equipment lock control unit 103 configured to alternately switch between setting and releasing the lock of the operation of the work equipment in a case where information indicating that the push button is OFF→ON→OFF is obtained from both of the first signal line and the second signal line, and release the lock of the operation of the work equipment only when a predetermined operation is performed on a predetermined operation device 32 of the work equipment when the lock of the operation of the work equipment is set in a case where the information indicating that the push button is OFF→ON→OFF is obtained from only one of the first signal line and the second signal line.

(2) The control device according to (1) further includes an alarm activation unit 104 configured to, when information indicating an occurrence of a predetermined fault is obtained from the first signal line or the second signal line, report the fact.

(3) The control device according to (1) or (2), in which, in a case where the push button is not OFF→ON→OFF in a state where the lock of the work equipment is released, when a predetermined condition for automatically setting the lock of the work equipment is established, the work equipment lock control unit sets the lock of the work equipment when the work equipment is controlled to be in a stop state.

(4) The control device according to any one of (1) to (3), in which the operation device includes a plurality of operation levers (boom operation lever 33 and bucket operation lever 34), and the predetermined operation includes an operation by a combination of predetermined operations for the plurality of operation levers.

(5) The control device according to any one of (1) to (4), in which the work equipment includes a bucket 12 that is a container for an object and a boom 11 configured to drive the bucket in an up-down direction, the operation device includes a bucket operation lever 34 configured to drive the bucket in a dump direction and a tilt direction and a boom operation lever 33 configured to drive the boom in the up-down direction, and the predetermined operation includes an operation of simultaneously performing an operation for the bucket operation lever that drives the bucket in the dump direction at a predetermined speed or more and an operation for the boom operation lever that drives the boom in a lowering direction at a predetermined speed or more.

INDUSTRIAL APPLICABILITY

According to the control device, the control method, and the work machine of the present disclosure, it is possible to achieve both safety and emergency operability in a configuration for locking the operation of the work equipment.

REFERENCE SIGNS LIST

1 Wheel loader (work machine)
2 Vehicle body
3 Cab
4 Traveling device
5 Wheel
6 Tire
10 Work equipment
11 Boom
12 Bucket (work tool)
12T Bucket teeth
13 Boom cylinder
14 Bucket cylinder
15 Bell crank
16 Link
17 Movable support section
32 Operation device
33 Boom operation lever
34 Bucket operation lever
37 Work equipment lock switch
371 Work equipment lock SW1
372 Work equipment lock SW2
100 Work equipment controller (control device)
101 Work equipment control unit
102 Signal input unit
103 Work equipment lock control unit
104 Alarm activation unit

The invention claimed is:

1. A control device of a work machine including work equipment, the control device comprising:

a signal input unit configured to input a signal from a first signal line connected to a normally open first switch configured to detect press and release of a momentary operation push button for setting and releasing lock of an operation of the work equipment, and input a signal from a second signal line connected to a normally closed second switch linked to the first switch (hereinafter, a state where the push button is pressed is referred to as ON, and a state where the push button is released is referred to as OFF); and a work equipment lock control unit configured to alternately switch between setting and releasing the lock of the operation of the work equipment in a case where information indicating that the push button is OFF→ON→OFF is obtained from both of the first signal line and the second signal line, and release the lock of the operation of the work equipment only when a predetermined operation is performed on a predetermined operation device of the work equipment when the lock of the operation of the work equipment is set in a case where the information indicating that the push button is OFF→ON→OFF is obtained from only one of the first signal line and the second signal line.

2. The control device according to claim 1, further comprising an alarm activation unit configured to, when information indicating an occurrence of a predetermined fault is obtained from the first signal line or the second signal line, report the fact.

3. The control device according to claim 2, wherein, in a case where the push button is not OFF→ON→OFF in a state where the lock of the work equipment is released, when a predetermined condition for automatically setting the lock of the work equipment is established, the work equipment lock control unit sets the lock of the work equipment when the work equipment is controlled to be in a stop state.

4. The control device according to claim 3, wherein the operation device includes a plurality of operation levers, and the predetermined operation includes an operation by a combination of predetermined operations for the plurality of operation levers.

5. The control device according to claim 4, wherein the work equipment includes a bucket that is a container for an object and a boom configured to drive the bucket in an up-down direction, the operation device includes a bucket operation lever configured to drive the bucket in a dump direction and a tilt direction and a boom operation lever configured to drive the boom in the up-down direction, and the predetermined operation includes an operation of simultaneously performing an operation for the bucket operation lever that drives the bucket in the dump direction at a predetermined speed or more and an operation for the boom operation lever that drives the boom in a lowering direction at a predetermined speed or more.

6. The control device according to claim 2, wherein the operation device includes a plurality of operation levers, and the predetermined operation includes an operation by a combination of predetermined operations for the plurality of operation levers.

7. The control device according to claim 6, wherein the work equipment includes a bucket that is a container for an object and a boom configured to drive the bucket in an up-down direction, the operation device includes a bucket operation lever configured to drive the bucket in a dump direction and a tilt direction and a boom operation lever configured to drive the boom in the up-down direction, and the predetermined operation includes an operation of simultaneously performing an operation for the bucket operation lever that drives the bucket in the dump direction at a predetermined speed or more and an operation for the boom operation lever that drives the boom in a lowering direction at a predetermined speed or more.

8. The control device according to claim 1, wherein the operation device includes a plurality of operation levers, and the predetermined operation includes an operation by a combination of predetermined operations for the plurality of operation levers.

9. The control device according to claim 8, wherein the work equipment includes a bucket that is a container for an object and a boom configured to drive the bucket in an up-down direction, the operation device includes a bucket operation lever configured to drive the bucket in a dump direction and a tilt direction and a boom operation lever configured to drive the boom in the up-down direction, and the predetermined operation includes an operation of simultaneously performing an operation for the bucket operation lever that drives the bucket in the dump direction at a predetermined speed or more and an operation for the boom operation lever that drives the boom in a lowering direction at a predetermined speed or more.

10. A control method of a work machine including work equipment, the control method comprising:

a step of inputting a signal from a first signal line connected to a normally open first switch configured to detect press and release of a momentary operation push button for setting and releasing lock of an operation of the work equipment, and inputting a signal from a second signal line connected to a normally closed second switch linked to the first switch (hereinafter, a state where the push button is pressed is referred to as ON, and a state where the push button is released is referred to as OFF);

a step of alternately switching between setting and releasing the lock of the operation of the work equipment in a case where information indicating that the push button is OFF→ON→OFF is obtained from both of the first signal line and the second signal line; and a step of releasing the lock of the operation of the work equipment only when a predetermined operation is performed on a predetermined operation device of the work equipment when the lock of the operation of the work equipment is set in a case where the information indicating that the push button is OFF→ON→OFF is obtained from only one of the first signal line and the second signal line.

11. A work machine comprising:

work equipment; and a control device including a signal input unit configured to input a signal from a first signal line connected to a normally open first switch configured to detect press and release of a momentary operation push button for setting and releasing lock of an operation of the work equipment, and input a signal from a second signal line connected to a normally closed second switch linked to the first switch (hereinafter, a state where the push button is pressed is referred to as ON, and a state where the push button is released is referred to as OFF), and a work equipment lock control unit configured to alternately switch between setting and releasing the lock of the operation of the work equipment in a case where information indicating that the push button is OFF→ON→OFF is obtained from both of the first signal line and the second signal line, and release the lock of the operation of the work equipment only when a predetermined operation is performed on a predetermined operation device of the work equipment when the lock of the operation of the work equipment is set in a case where information indicating that the push button is OFF→ON→OFF is obtained from only one of the first signal line and the second signal line.

* * * * *